US005549132A

United States Patent [19]

Butterfield et al.

[11] Patent Number: 5,549,132

[45] Date of Patent: Aug. 27, 1996

[54] CONVERTIBLE FUEL DISPENSING NOZZLE

[75] Inventors: Eric J. Butterfield, Middletown, Ohio; George R. Cockram, Apex, N.C.; Stewart M. Harmon, Knightdale, N.C.; Roy Talbot, Durham, N.C.

[73] Assignee: Emco Wheaton, Inc., Wilson, N.C.

[21] Appl. No.: 480,763

[22] Filed: Jun. 7, 1995

[51] Int. Cl.[6] ..... B67D 5/37

[52] U.S. Cl. ..... 137/270; 137/801; 141/206; 141/209

[58] Field of Search ..... 137/270, 269, 137/271, 801; 251/155, 156; 141/206, 209, 210, 217, 218

[56] References Cited

U.S. PATENT DOCUMENTS

| | | | |
|---|---|---|---|
| 2,524,509 | 10/1950 | Barney . | |
| 2,544,556 | 3/1951 | Kunert | 251/155 |
| 2,929,418 | 3/1960 | Ryan, Jr. . | |
| 3,026,896 | 3/1962 | Bosworth et al. | 137/270 |
| 3,063,465 | 11/1962 | Oros | 137/270 |
| 3,122,065 | 2/1964 | Laun | 137/270 X |
| 3,323,560 | 6/1967 | Ehlers . | |
| 3,332,457 | 7/1967 | Nisbet et al. . | |
| 3,677,281 | 7/1972 | Tennis | 137/270 |
| 4,036,259 | 7/1977 | Wilder et al. | 137/801 |
| 4,331,187 | 5/1982 | Trygg . | |
| 4,597,513 | 7/1986 | Schiemann . | |
| 4,640,855 | 2/1987 | St. Clair . | |
| 5,390,712 | 2/1995 | Parrish et al. | 141/206 X |

*Primary Examiner*—Kevin Lee
*Attorney, Agent, or Firm*—Bell, Seltzer, Park & Gibson, P.A.

[57] ABSTRACT

A fuel dispensing nozzle easily and readily convertible between two modes which meet the regulations and operational requirements of the United States and European countries, the nozzle including a body member having a fuel passageway therethrough, a main valve in the fuel passageway to control the flow of fuel through the passageway, the main valve being removably mounted in the fuel passageway and reversible when the nozzle is to be converted into a different mode, and a valve actuating mechanism for opening the main valve in one direction when the main valve is in one attitude and in the opposite direction when the valve is in its reversed attitude.

7 Claims, 4 Drawing Sheets

CONVERTIBLE FUEL DISPENSING NOZZLE

FIELD OF THE INVENTION

This invention relates to fuel dispensing nozzles and more particularly to a fuel dispensing nozzle which is readily and easily convertible between first and second modes which meet the operational requirements for use in the United States and in European countries.

BACKGROUND OF THE INVENTION

The rules, regulations and operational requirements for fuel dispensing nozzles differ in the United States and in European countries. While fuel dispensing nozzles for use in both environments include a manually operable trigger or lever which opens a main valve within the nozzle to dispense fuel through the nozzle and into a vehicle fuel tank, the rules, regulations and operational requirements dictate a different arrangement of the main valve and the linkage connecting the main valve to the manually operable lever.

In the United States, the regulations and operational requirements are such that the main valve member is disposed on the inlet side of the valve seat and opens by movement toward the inlet end of the nozzle. In other words, the main valve opens by moving upstream of the flow of fuel through the nozzle. Accordingly, the linkage connecting the manually operable lever, which in both cases is pivoted at the front end of the lever and moves upwardly to open the main valve, must be such that the valve stem is moved toward the inlet end of the nozzle.

In European countries, the regulations and operational requirements are such that the main valve member is disposed toward the outlet end of the nozzle from its associated valve seat and moves toward the outlet end of the nozzle to open. In other words, the main valve member moves downstream of the fuel flow through the nozzle to its open position. Accordingly, the linkage connecting the manually operable lever to the main valve must be such that the valve member is moved toward the outlet end of the nozzle to its open position.

Heretofore, because of the different rules, regulations and operational requirements, nozzles have been designed, engineered and manufactured solely for use in the United States or in European countries. There have previously been no nozzles which are easily and readily convertible for use in either of these two environments. Accordingly, companies manufacturing nozzles for both environments have been required to have separate and different designs, manufacturing operations and inventories. The difficulties in maintaining these separate and different systems are apparent and have increased the costs of manufacturing and selling fuel dispensing nozzles.

SUMMARY OF THE INVENTION

With the foregoing in mind, it is an object of the present invention to provide a fuel dispensing nozzle that is readily and easily convertible to meet the rules, regulations and operational requirements of either the United States or European countries and to overcome thereby the disadvantages and deficiencies of prior fuel dispensing nozzles.

The foregoing object is achieved by a fuel dispensing nozzle in accordance with the present invention which includes a body member having a fuel passageway extending longitudinally therethrough from an inlet end to an outlet end. A manually operable trigger or lever is pivotally mounted on the body member for movement upwardly about its pivot when fuel is desired to be dispensed through the nozzle. A main valve mechanism is provided in the fuel dispensing passageway and it includes a reversible valve seat which is removably received within the fuel passageway through the inlet end of the nozzle body member and which in one attitude provides a valve seat on the upstream side of the valve seat member to meet the specifications and regulations for use in the United States and which is reversible once removed to provide the same valve seat on the outlet end of the valve member with the valve seat facing downstream in the fuel passageway.

A valve member is removably and reversibly carried by a valve stem for cooperative operation with the valve seat to control the flow of fuel through the fuel passageway. The valve stem is slidably mounted in the body member within the fuel passageway and has a linkage connector at the end thereof opposite the valve member.

A linkage mechanism is provided between the manually operable lever and the linkage connector on the valve stem. This linkage mechanism includes a pivotally mounted member, the upper end of which is operatively associated with the linkage connector on the valve stem. The pivotal member is adapted to be connectible to the valve stem by the linkage connector in two different attitudes, the first attitude being such that the valve stem is moved toward the inlet end of the nozzle and the other attitude being such that the valve stem is moved by the pivotal member toward the outlet end of the nozzle.

The linkage mechanism also includes first and second operating means between the manually operated lever and the pivotal member. In the attitude wherein the pivotal member is to move the valve stem toward the inlet end of the nozzle, the first operating means is the operative means and comprises a cam surface on the manually operable lever. In the attitude where the pivotal member is to move the valve stem toward the outlet end of the nozzle, the second operating means is the operative means and comprises a bell crank lever mounted for rotation on the body member and having one leg thereof in contact with a recess in the manually operable lever and the other leg of the bell crank in contact with the pivotally mounted member.

With this nozzle structure, the nozzle is readily arranged in a first mode meeting the regulations and operational requirements for use in the United States by placing the valve seat member in the fuel passageway with the valve seat facing the inlet end and by placing the valve member on the valve stem on the inlet end side of the valve seat and facing the valve seat. The pivotal member of the operating linkage is connected to the valve stem on the outlet end side of the linkage connector and the pivotal member is then in contact with the cam surface on the manually operable lever.

The nozzle can be easily and readily converted to a second mode for use in an European country by removing the valve member from the valve stem and the valve seat member from the fuel passageway and reversing the valve member on the valve stem and reversing the valve seat member so that the valve seat faces the outlet end of the nozzle and the valve member is on the outlet end side of the valve seat. Similarly, the pivotal member of the operating linkage is moved to the inlet end side of the linkage connector on the valve stem and into contact with the other leg of the bell crank lever.

BRIEF DESCRIPTION OF THE DRAWING

Some of the objects and advantages of the present invention having been stated, others will appear as the description proceeds when considered in conjunction with the accompanying schematic drawings, in which.

DETAILED DESCRIPTION OF THE PREFERRED EMBODIMENT

Figure 1:
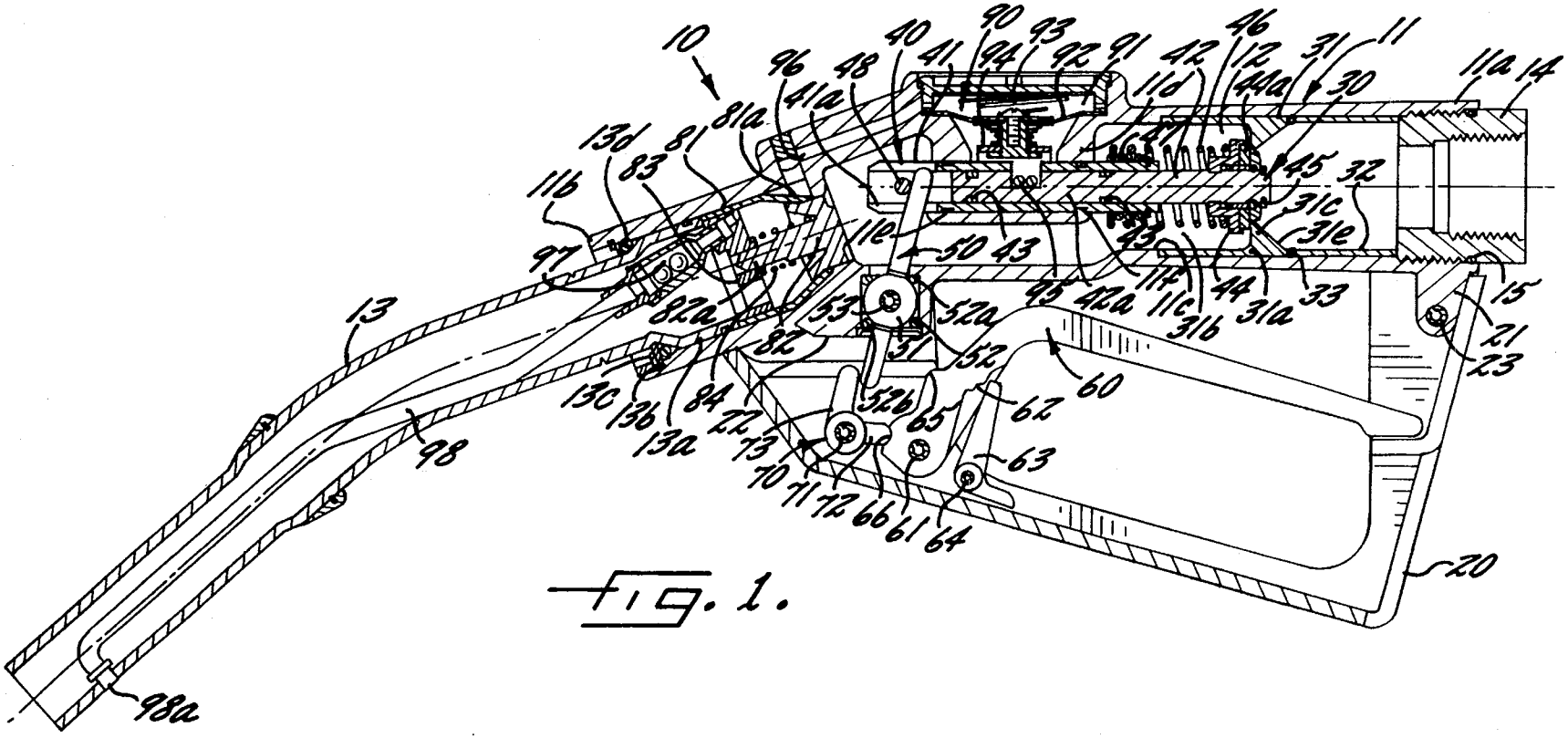
FIG. 1 is a longitudinal vertical sectional view of a nozzle incorporating the features of the present invention.
Figures 2, 3:
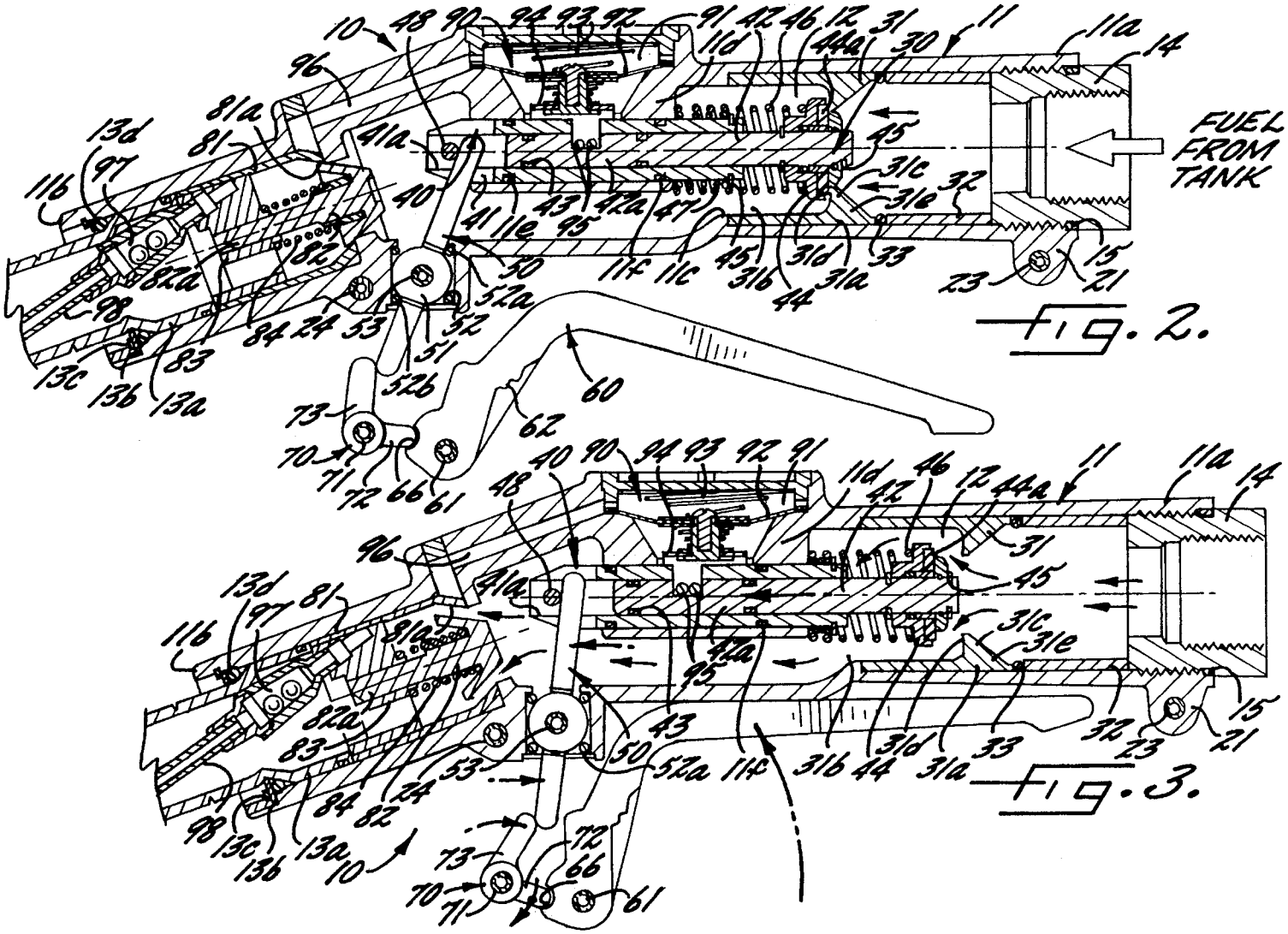
FIG. 2 is a fragmentary vertical sectional view of the medial portion of the nozzle shown in FIG. 1 with parts removed for clarity.
FIG. 3 Is a view similar to FIG. 2 showing the parts thereof in a different operational position.

Referring now more specifically to the drawings and particularly to FIGS. 1–3, there is illustrated therein a nozzle generally indicated at 10 incorporating the features of the present invention, with the nozzle 10 arranged in a mode meeting the regulations and operational requirements for use in European countries. Nozzle 10 includes a body member 11 having an inlet end 11*a* and an outlet end 11*b* and having a fuel passageway 12 extending longitudinally therethrough.

A spout 13 is connected to body member 11 at the outlet end 11*b* and has the inner end thereof in communication with the fuel passageway 12 through body member 11. The inner end portion 13*a* of spout 13 is of larger diameter than the remainder of the spout and is of only slightly less diameter than the interior diameter of the outlet end 111*b* of body member 11. Bell-shaped end portion 13*a* is inserted into outlet end 11*b* and is held therein by locking rings 13*b* and 13*c*. An O-ring seal 13*d* is positioned between the locking rings and the bell-shaped end portion 13*a*.

A connector 14 is threadably mounted in the inlet end 11*a* of body member 11 for connecting the inlet end 11*a* to a fuel hose (not shown), the other end of which is connected to a suitable pump mechanism (also not shown) for supplying fuel under pressure to nozzle 10. Connector member 14 has a suitable O-ring seal 15 around the outside thereof between the connecting member 14 and the inlet end 11*a* of body member 11.

Nozzle 10 further includes a hand guard 20 that is removably mounted on bosses 21, 22 on the lower side of body member 11 by pins 23, 24. Hand guard 20 is generally of conventional construction and need not be further described.

A main valve means 30 is mounted within body member 11 for controlling the flow of fuel through the nozzle 10. Main valve means 30 includes a valve seat member 31 which is tubular and includes a body portion 31*a* that is generally of an external diameter substantially the same as the internal diameter of the fuel passageway through the body member 11 and has its inner end 31*b* resting against a shoulder 11*c* formed on the interior of the body member 11. Valve seat member 31 includes a valve seat portion 31*c* which is annular and has a relatively flat valve seat 31*d* on one side thereof and a conical portion 31*e* on the other side thereof.

A tubular spacer member 32 is positioned between the valve seat member 31 and the connector member 14. An O-ring seal 33 is disposed between the inner end of the spacer member 32 and the valve seat member 31.

Main valve means 30 further includes a valve stem 40 comprising an elongate outer tubular member 41 and an inner member 42, an inner end portion 42*a* of which is slidably received within the interior of outer valve stem member 41. Suitable O-ring seals 43, 44 are provided between outer valve stem member 41 and inner valve stem member 42. Valve stem 40 is mounted for reciprocatory movement in an interior boss 11*d* on body member 11 within the fuel passageway 12. Boss 11*d* has an opening therethrough within which the valve stem 40 is slidably received. Suitable O-ring seals 11*e* and 11*f* are provided between boss 11*d* and valve stem 40.

A valve member 44 is removably mounted on the outer end portion 42*b* of inner valve stem member 42 by a suitable locking ring 45 which fits within a groove in the outer end portion 42*b* of valve stem member 42. Valve member 44 includes a sealing portion 44*a* which is adapted to seat against valve seat 31*d* to close the fuel passageway 12 to the flow of fuel therethrough.

A compression spring 46 is disposed between valve member 44 and boss 11*d* to bias the valve member 44 and inner valve stem member 42 toward the inlet end 11*a* of body member 11 and valve seat 31*d*. A second coil compression spring 47 is disposed between a locking ring 45 on the end of outer valve stem member 41 toward the valve seat 31*d* and the shoulder 11*d* to bias outer valve stem member 41 toward the inlet end 11*a* of body member 11.

The other end of outer valve stem member 41 has a slot 41*a* extending vertically through the end portion thereof and a linkage connector 48 extends horizontally across the slot 41*a* and has its opposite ends mounted in the bifurcated end portion of outer valve stem member 41. The slot 41*a* is adapted to receive the upper end portion 50*a* of a pivotally mounted linkage member 50. The medial portion of linkage member 50 includes a ball portion 51 which is received within a mounting cage 52 comprising upper and lower ball bearings 52*a* and 52*b*. A stabilizing pin 53 extends horizontally through an opening in the ball member 51 and has its opposite ends mounted in body member 11 to stabilize the pivotal member 50 so that it pivots only in one plane.

A manually operable lever 60 is provided within hand guard 20 and is pivotally mounted on hand guard 20 at its forward end by a pivot pin 61. The lower portion of manually operable lever 60 has a series of notches 62 therein which is adapted to coact with a hold-open clip 63 pivotally mounted on the hand guard 20 by a pivot pin 64.

Manually operable lever 60 includes a cam portion 65 on the side thereof facing the pivotally mounted linkage member 50 and a recess 66 in the lower end portion thereof facing the outlet end of body member 11 and adjacent pivot pin 61.

A bell crank member 70 is pivotally mounted on hand guard 20 by a pivot pin 71 and includes a first leg 72, the outer end of which is disposed in recess 66, and a second leg 73, the upper end of which is disposed on the outlet end side of the lower end portion 50*b* of pivotal linkage member 50.

A secondary, check valve 80 is mounted in fuel passageway 12 downstream of main valve 30 and includes a valve seat member 81 mounted within fuel passageway 12 and defining a valve seat 81*a* and a valve member 82 having a surface thereof adapted to seat against valve seat 81*a*. Valve member 82 has a stem portion 82*a* slidably mounted in a spider 83 mounted within valve seat member 81. A spring 84 biases the valve member 82 to the closed position. Spring 84 is selected to have a biasing force less than the pressure of fuel supplied to the nozzle 10 such that when main valve 30 is open the pressure of fuel against the valve member 82 will force the same to the open position by compressing spring 84.

Nozzle 10 is equipped with an automatic shut-off mechanism generally indicated at 90 which will cause main valve 30 to close once the vehicle tank is full of fuel. This shut-off mechanism is generally described in U.S. Pat. No. 5,390,712 issued Feb. 21, 1995 and assigned to the same assignee as this application. That description in U.S. Pat. No. 5,390,712 is incorporated herein by reference.

Generally, automatic shut-off mechanism 90 includes a venturi mechanism (not shown) that communicates with fuel passageway 12 through body member 11 into a chamber 91, one side of which is defined by a flexible diaphragm 92. Diaphragm 92 is biased downwardly by a spring 93 and is connected to a connecting or spider member 94. Spider member 94 is of an inverted U-shape having leg portions straddling the valve stem 40. Opposite ends of a pair of pins 95 are mounted in horizontal slots (not shown) in the legs of spider member 94 and are adapted to be received in mating grooves in the outer and inner valve stem members 41 and 42.

A passageway 96 extends from the chamber 91 to the outlet end of body member 11 and is connected by a position responsive valve 97 to a shut-off passageway 98 which terminates adjacent the outer end of spout 13 in an outer end opening 98*a*. When fuel is flowing through nozzle 10, the venturi creates a vacuum in chamber 91 which draws air from the fuel tank into the chamber 91 through passageways 96 and 97. When the vehicle tank is full and fuel closes the outer end 97*a* of passageway 97, the vacuum created by the venturi in chamber 91 draws the diaphragm 92 upwardly which removes the pins 95 from the groove in the inner valve stem member 42. The spring 46 then moves the valve member 44 and inner valve stem member 42 toward the inlet end of the nozzle body member 11 and into contact with valve seat 31*d* to close the main valve 30. Once the manually operated lever 60 is released, the outer valve stem member 41 is forced to the right by a spring 47 permitting the two grooves in the valve stem members to align and the pins 95 to drop into the mating grooves because the venturi action on chamber 91 ceases once fuel ceases to flow through fuel passageway 12.

FIGS. 1 through 3 illustrate the nozzle 10 in a mode which meets the regulations and operational requirements of fuel dispensing nozzles for use in European countries. In this mode, the valve seat 31*d* faces toward the outlet end 11*b* of the nozzle 10 and the valve member 44 is disposed on the downstream side of valve seat 33*d*. The upper end portion 50*a* of linkage member 50 is disposed in the slot 41*a* in outer valve stem member 41 on the upstream side of the linkage connector 48 and the lower end portion 50*b* of linkage member 50 is in contact with the second leg 73 of bell crank member 70.

Upon upward movement of manually operable lever 60, the recess 66 of manually operable lever 60 will force the first leg 72 of bell crank member 70 downwardly (as seen in FIGS. 1 through 3) thereby rotating or pivoting bell crank member 70 in a clockwise direction. Such pivotal or rotational movement of bell crank 70 will cause the second leg 73 to pivot linkage member 50 counter clockwise about the ball portion 51 and stabilizing pin 53. The upper end portion 50*a* of linkage member 50 will engage the linkage connector 48 on valve stem 40 and move the valve stem toward the outlet end 11*b* of the body member 11 thereby opening the main valve 30 (FIG. 3).

Figure 4:
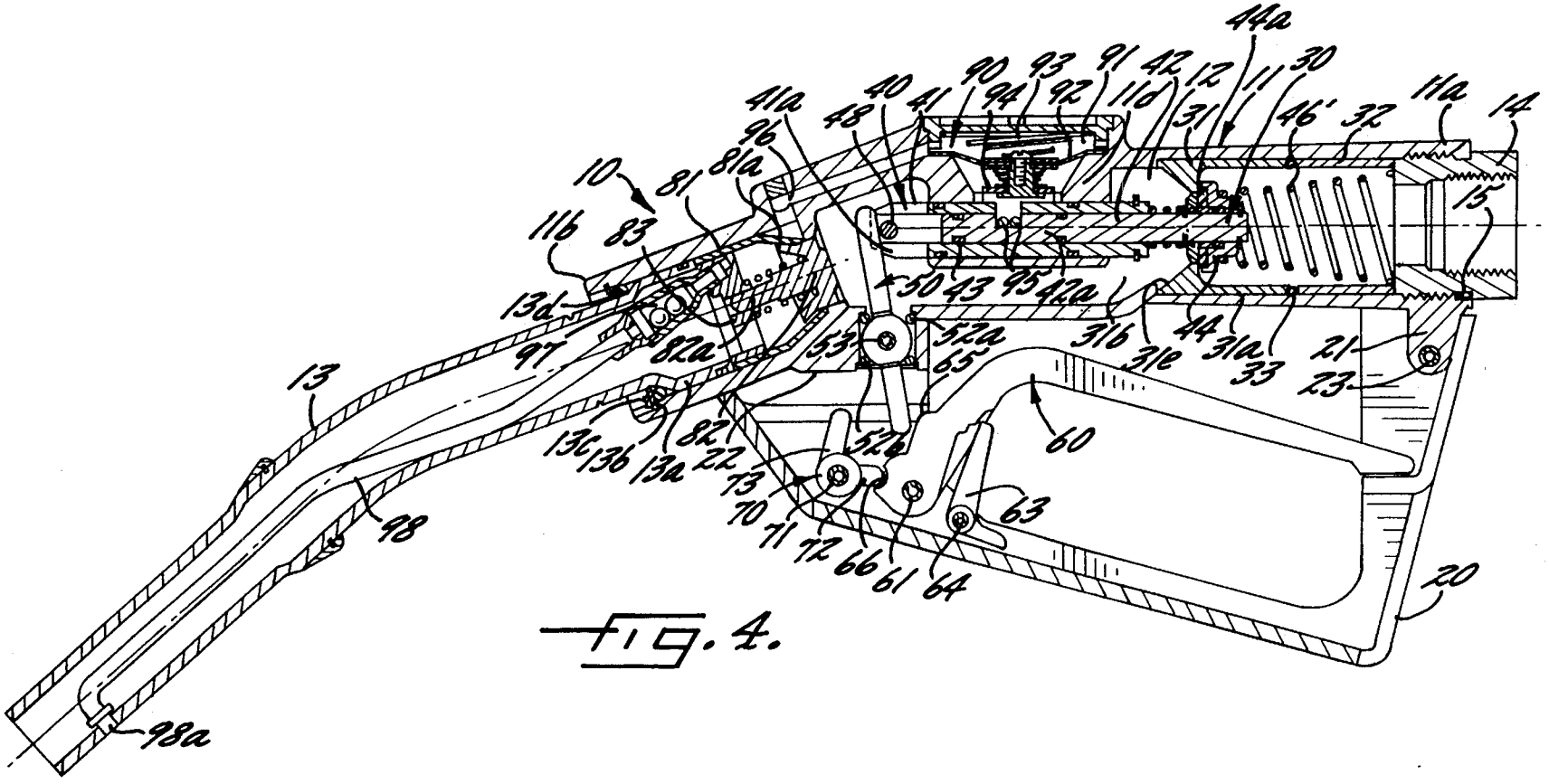
FIG. 4 is a view similar to FIG. 1 with the operating mechanism of the nozzle converted to a different operational mode.
Figures 5, 6:
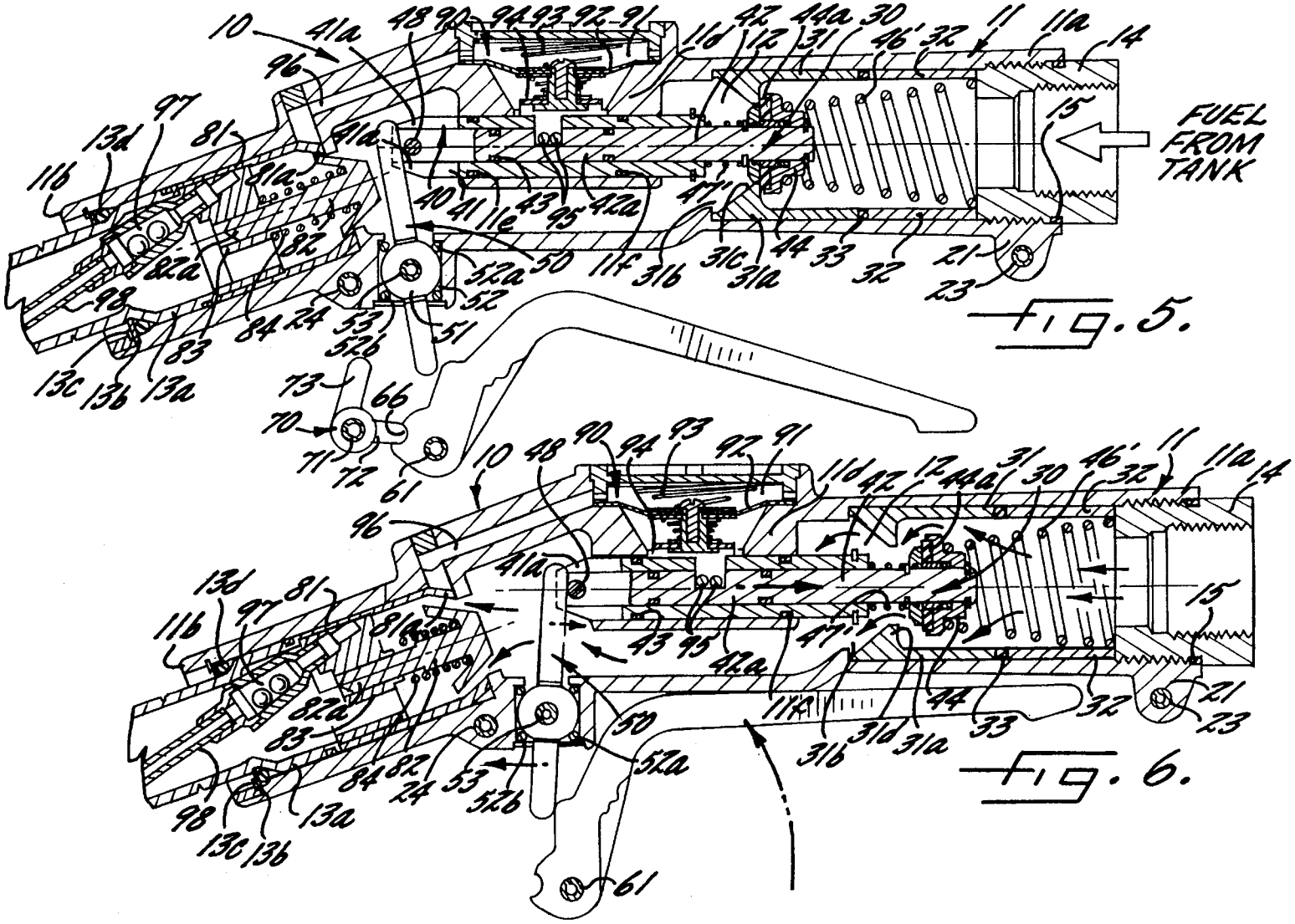
FIG. 5 is a view similar to FIG. 2 of the nozzle shown in FIG. 4.
FIG. 6 is a view similar to FIG. 3 showing the nozzle in FIGS. 4 and 5 in a different operational position.

Referring now to FIGS. 4 through 6, the nozzle 10 of the present invention is shown as having been converted from the mode shown in FIG. 1 through 3 to a mode meeting the regulations and operational requirements for use in the United States. This conversion is readily and easily effected by removing the connector member 14 from the inlet end 11*a* of body member 11. The spacer member 32 can then be removed as can be valve seat member 31. Similarly, valve member 44 can be removed from the end of outer valve member 42 by removing the locking ring 45. The coil springs 46 and 47 are also removed.

A different size compression spring 47' is placed in surrounding relation to the outer end portion 42*b* of inner valve stem member 42 between valve member 44 and the end of outer valve stem member 41 to bias outer valve stem member 41 toward the outer end 11*b* of body member 11. Valve seat member 31 is reversed and replaced in fuel passageway 12 with the valve seat 31*d* facing the inlet end 11*a* of the body member 11. Valve member 44 is similarly reversed and replaced on the outer end portion 42*b* of inner valve stem member 42. The locking ring 45 is then replaced to lock the valve member on the outer end portion 42*b* of inner valve stem member 42. Spacer member 32 is then replaced to hold the valve seat member 31 in position. Another compression spring 46' is inserted within the valve seat member 31 and spacer member 32 with the inner end thereof against valve member 44. The connector member 14 is replaced in the inlet end 11*a* of body member 11 such that the outer end of spring 46' presses against the inner end of connector member 14.

The upper end 50*a* of pivotal member 50 is removed from the slot 41*a* and is positioned on the outlet end side of the linkage connector 48. The lower end portion 50*b* thereof is thusly positioned adjacent the cam portion 65 on manually operable lever 60. Bell crank member 70 may be removed or may be left in place.

As shown in FIG. 6, when manually operable lever 60 is moved upwardly, the cam portion 65 engages the lower end portion 50*b* of pivotal member 50 forcing that linkage member to pivot in a clockwise direction with the upper end portion 50*a* thereof pressing against the linkage connector 48 and forcing the valve stem 40 toward the inlet end of body member 11 thereby opening main valve 30.

In the drawings and specifications, there has been set forth a preferred embodiment of the invention, and although specific terms are employed, they are used in a generic and descriptive sense only and not for purposes of limitation, the scope of the invention being set forth in the following claims.

What is claimed is:

1. A fuel dispensing nozzle which can be easily converted into a first mode adapted for use in the United States and into a second mode adapted for use in European countries, said nozzle comprising an elongate body member having a fuel passageway extending longitudinally therethrough from a fuel inlet at one end of said body member to a fuel outlet at the other end thereof, valve means removably mounted in said body member for movement between open and closed positions for controlling fuel flow through said fuel passageway, said valve means being reversible upon removal from said body member and reinsertable within said body member between a first attitude in which said valve means moves from the closed position to the open position in one direction and a second attitude in which said valve means moves from the closed position to the open position in the opposite direction, a manually operable lever pivotally mounted on said body member for movement when fuel is desired to be dispensed, and valve actuating means between said lever and said valve means for opening said valve means in one direction when said valve means is in said first attitude and for opening said valve means in the opposite direction when said valve means has been reversed and is in said second attitude.

2. A fuel dispensing nozzle according to claim 1 wherein said valve means comprises a valve seat member having a valve seat thereon, said valve seat facing in a direction longitudinally of said body member, said valve seat member being removably mounted in said fuel passageway and being reversible when removed and reinsertable in a reversed attitude to change the direction in which said valve seat faces.

3. A fuel dispensing nozzle according to claim 2 wherein said valve means further comprises a valve stem mounted in said body member for movement longitudinally of said fuel passageway and a valve member removably mounted on one end portion of said valve stem for engagement with said valve seat to control flow of fuel through said fuel passageway, said valve member being reversible when removed from said valve stem and remountable in reversed attitude to cooperate with said valve seat in its different attitudes.

4. A fuel dispensing nozzle according to claim 3 including spring means biasing said valve member toward said valve seat and thereby biasing said valve means toward its closed position, said spring means being removably mounted in said body member on one side of said valve member when said valve member is in one attitude and being removable upon removal of said valve member and being replaceable on the other side of said valve member when said valve member is in its other attitude.

5. A fuel dispensing nozzle according to claim 4 wherein said valve actuating means includes a linkage member pivotally mounted in said body member and operatively connected to said valve stem, and means operable by said manually operable lever and operatively associated with said linkage member for pivoting said linkage member in one direction when said valve means is in one attitude and in the opposite direction when said valve means is in its other attitude.

6. A fuel dispensing nozzle characterized by the capability of being readily and easily convertible into either of first and second modes, said nozzle comprising an elongate body member having a fuel passageway extending longitudinally therethrough from a fuel inlet at one end of said body member to a fuel outlet at the other end of said body member, a spout mounted on said body member at said outlet end thereof and extending outwardly therefrom for delivering fuel from said outlet of said fuel passageway into a vehicle fuel tank, main valve means in said fuel passageway for controlling the flow of fuel through said fuel passageway, said main valve means comprising a reversible valve seat removably mounted in said body member in surrounding relation to said fuel passageway, said valve seat facing said fuel inlet in one attitude and being removable and reversible to face said fuel outlet in its other attitude, said main valve means further comprising a reversible valve member for cooperating with said valve seat in closing and opening said fuel passageway, a valve stem carrying said reversible valve member at one end thereof and being mounted for reciprocating movement within said body member for moving said valve member into and out of contact with said valve seat, and spring means biasing said valve stem and valve member toward said valve seat, and actuating means carried by said body member for selectively moving said valve member away from said valve seat, said actuating means comprising a pivotally mounted lever manually operable by a user desiring to dispense fuel through said nozzle, a pivotally mounted linkage member connected to said valve stem and operable when pivoted in one direction to move said valve stem and valve member toward said fuel inlet and when pivoted in the opposite direction to move said valve stem and valve member toward said fuel outlet, and means operable upon pivotal movement of said manually operable lever for selectively pivoting said valve actuating member in the direction to move said valve member away from said valve seat depending upon the attitude of said valve seat and valve member.

7. A fuel dispensing nozzle according to claim 6 wherein said means for pivoting said linkage member comprises a cam portion on said manually operable lever engageable with said linkage member when said valve member is to be moved toward said fuel inlet and a bell crank member operable by said manually operable lever and engageable with said linkage member when said valve member is to be moved toward said fuel outlet.

* * * * *